US006503177B2

(12) United States Patent
Herman

(10) Patent No.: US 6,503,177 B2
(45) Date of Patent: Jan. 7, 2003

(54) POGO STICK

(75) Inventor: William Paul Herman, Marblehead, MA (US)

(73) Assignee: HL Corporation, Hsin Chu Hsien (TW)

( * ) Notice: Subject to any disclaimer, the term of this patent is extended or adjusted under 35 U.S.C. 154(b) by 122 days.

(21) Appl. No.: 09/815,776

(22) Filed: Mar. 24, 2001

(65) Prior Publication Data

US 2002/0137602 A1 Sep. 26, 2002

(51) Int. Cl.[7] ..... A63B 26/00
(52) U.S. Cl. ..... 482/77; 482/92; 482/121
(58) Field of Search ..... 482/77, 3, 1, 908, 482/5–9, 112, 113, 73–76; 472/135

(56) References Cited

U.S. PATENT DOCUMENTS

| | | | |
|---|---|---|---|
| 2,871,016 | A | 1/1959 | Rapaport |
| 3,731,920 | A | 5/1973 | Matsuda |
| 3,773,320 | A | 11/1973 | Samiran et al. |
| D263,485 | S | 3/1982 | Radell et al. |
| 4,756,524 | A | 7/1988 | Cooney |
| D316,280 | S | 4/1991 | White |
| 5,087,037 | A | 2/1992 | Morrow |
| 5,102,119 | A | 4/1992 | Gerlach |
| 5,292,295 | A | 3/1994 | Gerlach |

FOREIGN PATENT DOCUMENTS

| | | |
|---|---|---|
| KR | WO 99/61111 | 12/1999 |

*Primary Examiner*—Jerome W. Donnelly
(74) *Attorney, Agent, or Firm*—Eric Karich

(57) ABSTRACT

A pogo stick has an upper tubular member with a hand graspable means on an upper end and a foot engageable means on a lower end, and a lower slider member with a top end and a bottom end, the top end being shaped to telescopically engage the lower end of the upper tubular member, and the bottom end having a removable bumper having a co-molded rubber portion. The lower slider member slides between a retracted position and an extended position, and the upper tubular member includes a spring assembly for biasing the lower slider member towards the extended position. The pogo stick includes a spring assembly that includes springs of varying strengths which, in conjunction with a compression assembly that pre-compresses the spring assembly, enables the user to customize the desired spring characteristics. The hand graspable means includes a novel pair of laterally extending hand grips that can be attached to the upper tubular member with a clamping mechanism supported by an inner lip. The foot engageable means includes a novel pair of laterally extending foot pegs that can be attached to the upper tubular member with a clamping mechanism supported by a locking collar.

38 Claims, 4 Drawing Sheets

POGO STICK

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates generally to pogo sticks, and more particularly to a pogo stick having an adjustable spring assembly, an improved, removable bumper, and a construction that allows for inexpensive mass production of the pogo stick.

2. Description of Related Art

The following art defines the present state of this field:

Samiran et al., U.S. Pat. No. 3,773,320, teaches a pogo stick in which the spring is adjustable and which includes a latch which will hold the stick in collapsed position and which can be selectively released to permit operation of the stick. The spring can be adjusted manually or automatically.

H. I. Rapaport, U.S. Pat. No. 2,871,016, teaches a pogo stick whish has a leg member of supporting pole, which is retractable when not in use to reduce the length of the unit to permit shipment and storage of same in a minimum of space.

Gerlach, U.S. Pat. No. 5,292,295, teaches an exercise device made from one or more lengths of metallic or a fiber reinforced plastic matrix material. A portion of the length of material adjacent opposite ends are attached to one another to form an annular spring in either a U-shaped, tear drop, elliptical, or circular shape. A hand grip and foot support are mounted to the annular spring. In one embodiment, the annular spring means is mounted in a metal housing of limited spring characteristics. The U-shaped, tear drop, and circularly configured annular spring has a stabilizing bar telescopically mounted to the annulus spring at diametrically opposite locations. The elliptical embodiment includes a pair of annular elliptical springs mounted one on top of the other at locations intersecting the minor axis. Other embodiments have a stabilizing bar offset from the annulus with one end of the bar fixedly clamped to the annulus and a portion of the bar adjacent the opposite end offset from the annulus and slidably clamped thereto. One or more arcuate spring segments may be mounted to the annular spring for adjusting the weight range and bouncing characteristics. An elastomer band may be mounted to the annular spring of any of the embodiments so that it extends substantially parallel to the utility surface for increasing the weight range, and rebound of the device.

Gerlach, U.S. Pat. No. 5,102,119, teaches an exercise device using a fiber reinforced plastic matrix hoop as a resilient member with telescoping rigid members each connected at respective diametrically opposed locations on the hoop. A handle and foot support are coupled to one of the telescoping members. Elongated weight adjusting members having a length greater than the diameter of the hoop may be fastened at opposite ends to the diametrically opposed locations for incrementally increasing the weight range of the device. Another embodiment using fiber reinforced plastic bow springs as the resilient members are fastened to opposite ends of the telescoping rigid members. The resilient member may or may not be used with the bow springs.

Morrow, U.S. Pat. No. 5,087,037, teaches a pneumatically elevating recreational exercise device that utilizes in its preferred embodiment a commercially manufactured air cylinder as an extendable air spring that is secured to a horizontal surface or stand. A safety harness attachment for securing a body harness is also provided. The device produces dramatic extension, or elevating capacity for vertical rebounding movement, and is entirely self-contained. An aspirating check-valve is used to admit air at the top of the stroke, which produces added elevation with each vigorous leaping effort. This concept is also applied to an unsecured toy pogo stick embodiment.

Cooney, U.S. Pat. No. 4,756,524, teaches a device, used in pairs, to provide upper body exercise to walkers, joggers and runners. A device which provides a total body exercise concept for said users. A device which emulates cross-country skiing during said use. A device which has a frame with a handgrip and foot thereon. The handgrip height can be adjusted as required. Weights can be added to the frame for a more balanced exercise routing of upward and downward force. The changeable foot is designed for ground and other supporting surface contact and provide for the rocking motion of the frame and to maintain good ground coefficient of friction.

Matsuda, U.S. Pat. No. 3,731,920, teaches a bottom tip for the leg or pole of a pogo stick, which tip comprises a member formed of a resilient material, such as rubber or the like, provided with an intermediate annular groove or recess in which the lower end of the tubular leg or pole is received so that a portion of the resilient material of the tip is within the tubular leg adjacent the bottom thereof and a portion of the tip surrounds the leg, and in which the bottom edge of the leg is spaced from the bottom of the annular groove or recess, with a rigid retaining ring surrounding the outer portion of the resilient member.

Radell et al, U.S. Des. Pat. No. 263,485, and White, U.S. Des. Pat. No. 316,280, teach an ornamental design for a pogo stick.

Oh, Ju-Whan, WO 99/61111, teaches an invention called "Air-Pogo stick" worked by an air cylinder. While previous devices whose elasticity is fixed are unable to be adjusted to excesses or elasticity, this invention can be adjusted to them. On the whole this invention is made up of two main parts: a handle grip which a user holds when he jumps on the foot-boards, and an air cylinder to which foot-boards are attached in a body. In particular the air cylinder has a valve through which a user can regulate air. This invention is simultaneously worked by both air pressure power and vacuum power created in the upper and lower part of the piston in the cylinder respectively, when exerted by an outside force. And both the powers can create a soft and strong jumping power, which gives the user pleasure as well as high kinetic effect.

The prior art teaches pogo sticks having a general structure similar to the present invention. However, the prior art does not teach the specific features, described in the following summary.

SUMMARY OF THE INVENTION

The present invention teaches certain benefits in construction and use which give rise to the objectives described below.

The present invention provides a pogo stick having an upper tubular member and a lower slider member. The upper tubular member has a hand graspable means on an upper end and a foot engageable means on a lower end. The lower slider member has a top end and a bottom end, the top end being shaped to telescopically engage the lower end of the upper tubular member, and the bottom end having a bumper. The lower slider member slides between a retracted position and an extended position, and the upper tubular member includes a spring assembly for biasing the lower slider member towards the extended position. The pogo stick includes several novel features that enable the pogo stick to be customized to the needs of the user, the novel features further enabling the pogo stick to be manufactured inexpensively.

A primary objective of the present invention is to provide a pogo stick having advantages not taught by the prior art.

Another objective is to provide a pogo stick that includes a spring assembly that includes springs of varying strengths which, in conjunction with a compression assembly that pre-compresses the spring assembly, enables the user to customize the desired spring characteristics. The spring assembly also includes a spring carrier that not only provides a stable connection between the springs, it also provides a bearing surface for contacting the internal surface of the upper tubular member.

A further objective is to provide a pogo stick that includes a novel pair of laterally extending hand grips that can be attached to the upper tubular member without welding or adhesives, the pair of laterally extending hand grips having an inner lip that bears the brunt of any downward forces exerted upon the hand grasping means.

A further objective is to provide a pogo stick that includes a novel pair of laterally extending foot pegs that are attached to the upper tubular member in a fashion similar to the pair of laterally extending hand grips, the pair of laterally extending foot pegs being supported by a locking collar that bears the brunt of any downward forces exerted upon the foot pegs.

A further objective is to provide a pogo stick that includes a bumper that is more durable than the prior art bumpers and easier to replace when worn.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
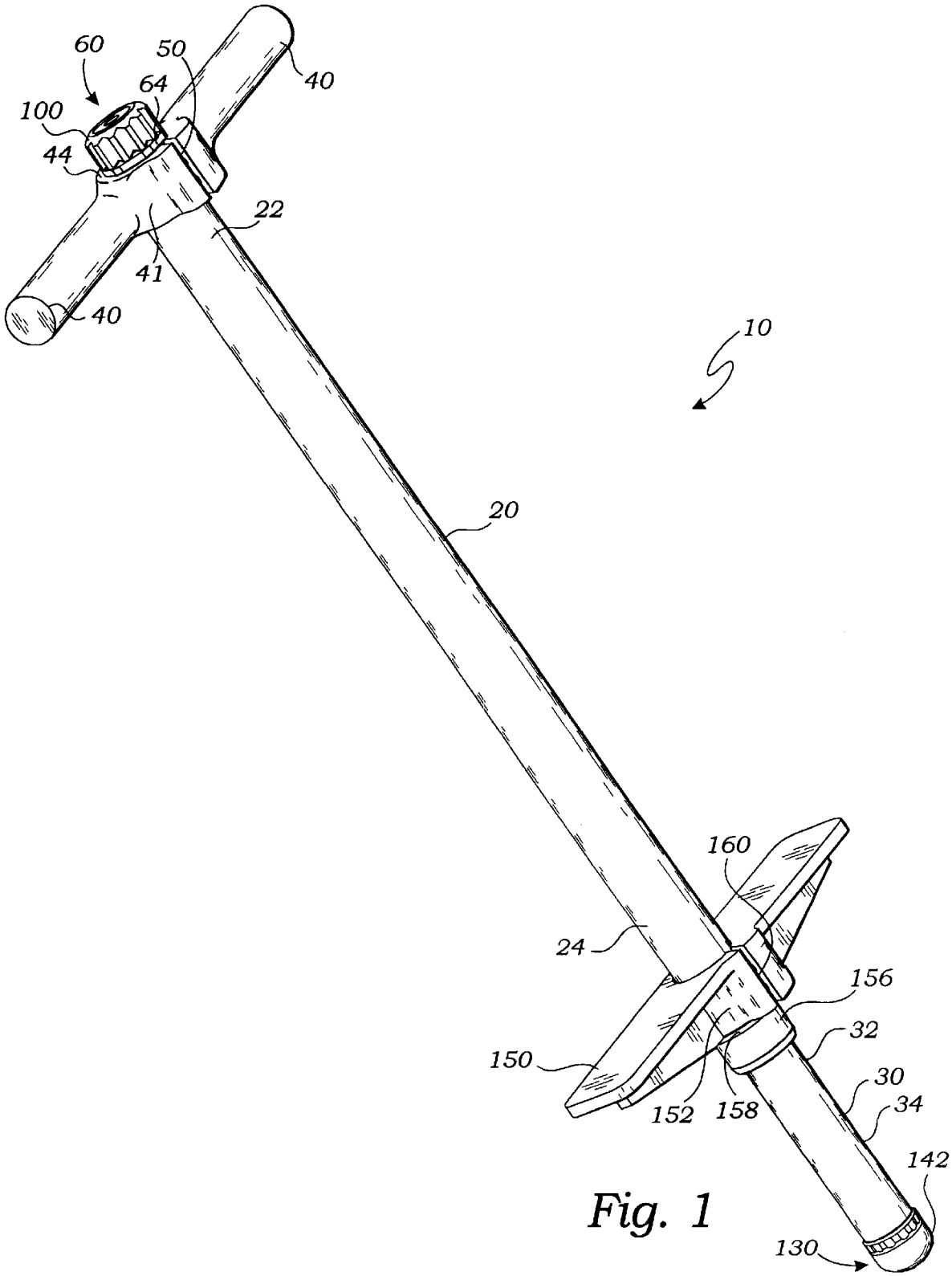
FIG. 1 is a perspective view of the preferred embodiment of the present invention.

The above described drawing figures illustrate the invention, a pogo stick 10 having an upper tubular member 20 and a lower slider member 30. As shown in FIG. 1, the upper tubular member 20 has a hand graspable means attached to an upper end 22 and a foot engageable means attached to a lower end 24. The lower slider member 30 has a top end 32 and a bottom end 34, the top end 32 being shaped to telescopically engage the lower end 24 of the upper tubular member 20, and the bottom end 32 shaped to removably engage a bumper 130. The lower slider member 30 slides between a retracted position and an extended position, and the upper tubular member 20 includes a spring assembly 110 for biasing the lower slider member 30 towards the extended position. The pogo stick 10 is used to enable a user to stand upon the foot engageable means, grasp the hand graspable means, and jump with the assistance of the spring assembly 110, for both amusement and exercise. The general configuration of the pogo stick 10 is known in the art, and is illustrated in Samiran et al., U.S. Pat. No. 3,773,320, and H. I. Rapaport, U.S. Pat. No. 2,871,016, hereby incorporated by reference.

Hand Graspable Means

Figure 2:
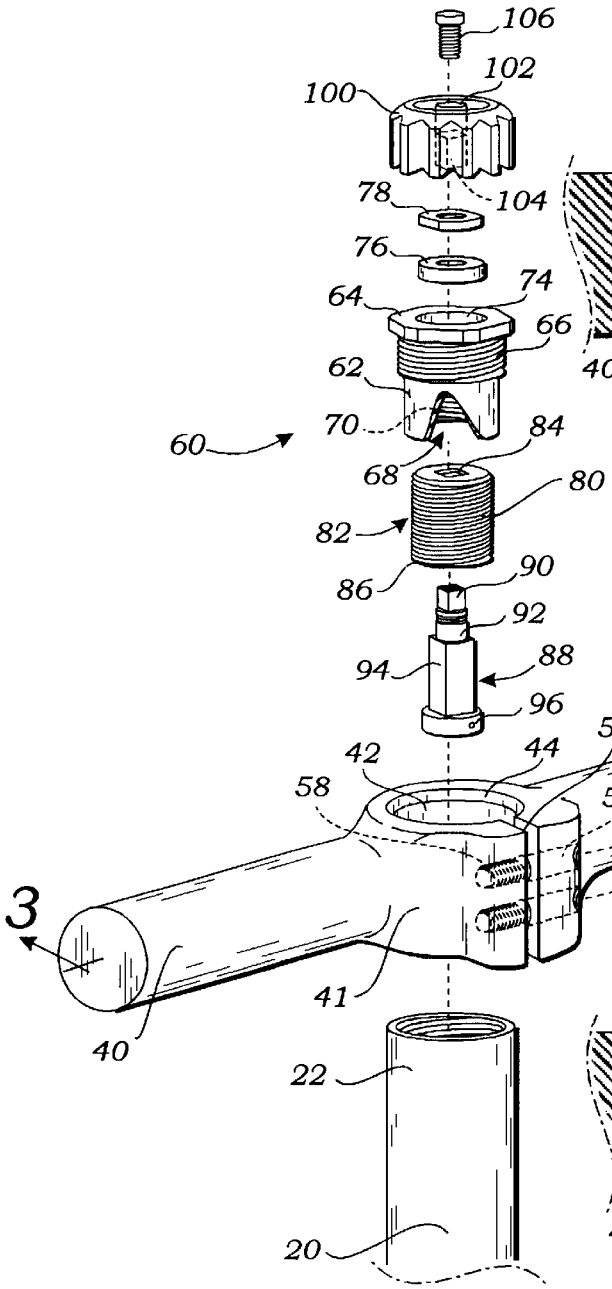
FIG. 2 is an exploded perspective view thereof illustrating an upper end of an upper tubular member, a pair of laterally extending hand grips, and a compression assembly.
Figure 3:
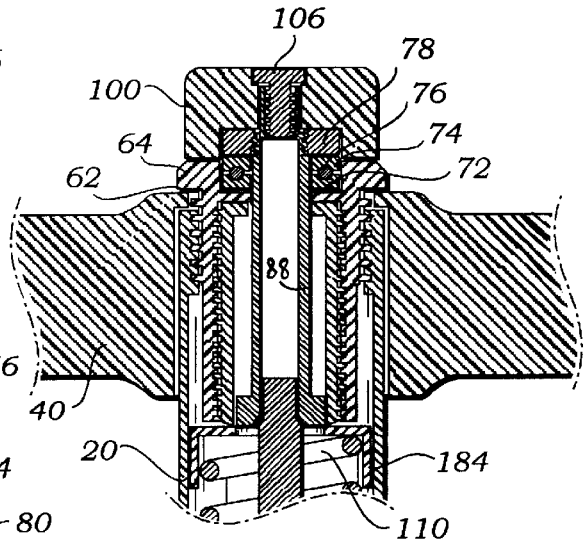
FIG. 3 is a sectional view thereof taken along line 3—3 in FIG. 2, the view illustrating the compression assembly in an uncompressed position.
Figure 4:
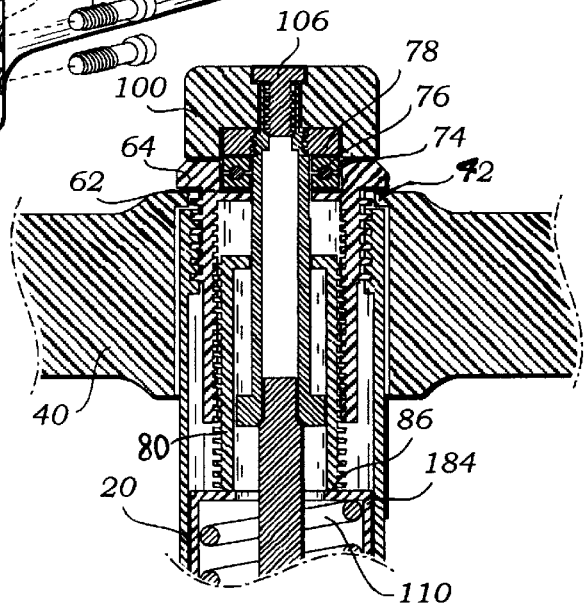
FIG. 4 is a sectional view thereof illustrating the compression assembly in a compressed position.

As shown in FIGS. 2–4, the hand graspable means preferably includes a pair of laterally extending hand grips 40 that incorporate a novel attachment mechanism that enables the hand graspable means to be securely attached to the upper tubular member 20 without welding, adhesives, or penetrating the upper tubular member 20 with attachment bolts. In the preferred embodiment, the pair of laterally extending hand grips 40 are connected to a hand grip base 41 having a hand grip central bore 42. The hand grip central bore 42 has an internal lip 44 that is critical, the internal lip 44 being shaped to block passage of the upper end 22 of the upper tubular member 20 when the upper tubular member 20 is inserted into the hand grip central bore 42. When the pair of laterally extending hand grips 40 are positioned on the upper tubular member 20, the internal lip 44 bears all of the downward forces exerted upon the a pair of laterally extending hand grips 40.

The hand grip base 41 further includes a means for preventing twisting of the pair of laterally extending hand grips 40 with respect to the upper tubular member 20. The means for preventing twisting preferably includes a hand grip locking slot 50 that exposes the hand grip central bore 42, thereby providing the hand grip base 41 with a generally C-shaped cross-section. When the pair of laterally extending hand grips 40 are positioned on the upper tubular member 20, a hand grip pinch bolt 52 having a hang grip bolt head 54 is positioned through a hand grip locking aperture 56 that is large enough to receive the hand grip pinch bolt 52 but not the hang grip bolt head 54, and screwed into an internally threaded hand grip locking bore 58 shaped and positioned to receive the hand grip pinch bolt 52. By tightening the hand grip pinch bolt 52, the hand grip pinch bolt 52 functions to pinch closed the hand grip locking slot 50 and frictionally lock the hand grip base 41 onto the upper tubular member 20. When the hand grip pinch bolt 52 is threadedly rotated into or out of the internally threaded hand grip locking bore 58, the hand grip pinch bolt 52 enables the closing and opening of the hand grip locking slot 50. In the most preferred embodiment, the hand grip base 41 includes two of the hand grip pinch bolts 52 for added strength and security.

The hand graspable means preferably further includes a cap attachable to the upper end 22 of the upper tubular member 20 over the hand grip base 41, the cap having a retaining flange 64 that locks the internal lip 44 against the upper end 22, thereby preventing the upward movement of the hand grip base 41. The addition of the cap provides even greater strength and security to the attachment of the hand grip base 41 to the upper tubular member 20. The cap is preferably provided by a compression assembly housing 62, described in more detail below; however, a simpler device, having the necessary retaining flange 64 or equivalent locking element, can be devised by those skilled in the art if the compression assembly 60 is not included in the pogo stick 10. While the preferred embodiment is described above, alternative embodiments of the hand graspable means can be devised by those skilled in the art, including handlebars shown in Rapaport, or a vertical grip shown in Samiran.

Compression Assembly

As shown in FIGS. 2–4, the pogo stick 10 preferably includes a means for compressing the spring assembly 110 to enable the user to change the spring characteristics of the spring assembly 110. This technique is especially effective when multiple springs having different spring characteristics are used, as described below. This enables the pogo stick 10 to accommodate users of different weights, and to provide jumping characteristics that match the specific needs and desires of the current user.

The means for compressing the spring assembly 110 is positioned at the upper end 22 of the upper tubular member 20 to compress the spring assembly 110 towards the lower slider member 30. The means for compressing is preferably a compression assembly 60 including a compression assembly housing 62 and a cylindrical internal screw element 80. The compression assembly housing 62 is inserted into the upper end 22 of the upper tubular member 20 such that a threaded housing surface 66 threadedly engages the upper end 22 of the upper tubular member 20. The compression assembly housing 62 further includes an internal screw receiving recess 68 with a threaded internal surface 70. The internal screw receiving recess 68 is shaped to receive the cylindrical internal screw element 80 and threadedly engage a threaded external surface 82 of the threaded internal surface 70.

The compression assembly 60 further includes a means for rotating the cylindrical internal screw element 80 with respect to the compression assembly housing 62, thereby moving the cylindrical internal screw element 80 between an uncompressed position, as shown in FIG. 3, and a compressed position, as shown in FIG. 4, in which the cylindrical internal screw element 80 compresses the spring assembly 110 towards the lower slider member 30.

The means for rotating the cylindrical internal screw element 80 preferably includes an internal carrier screw 88 having an internally threaded square plug element 90, an extension portion 92 having a circular cross section, a square rod section 94, and a screw stop 96. The cylindrical internal screw element 80 has a screw carrier receiving aperture 84 at one end and a screw cap bearing surface 86 at the other end, the screw carrier receiving aperture 84 being shaped to slidably engage the square rod section 94 when the internal carrier screw 88 is inserted through the screw carrier receiving aperture 84, but not allow the screw stop 96 to pass therethrough. In this embodiment, the compression assembly housing 62 further includes an extension portion 92 receiving aperture 72 surrounded by a ball bearing receiving recess 74. A ball bearing assembly 76 is positioned within the ball bearing receiving recess 74 and locked in place with a locking nut 78. A hand knob 100 having a knob aperture 102 and an internal square hole 104 is attached to the internally threaded square plug element 90 with a locking screw 106, the internally threaded square plug element 90 fitting snugly within the internal square hole 104 and locked in place with the locking screw 106 such that rotation of the hand knob 100 is transmitted through the internal carrier screw 88 to the cylindrical internal screw element 80.

The cylindrical internal screw element 80 is positioned within the internal screw receiving recess 68 of the compression assembly housing 62 such that the threaded external surface 82 of the cylindrical internal screw element 80 threadedly engages the threaded internal surface 70 of the internal screw receiving recess 68. The cylindrical internal screw element 80 is positioned within the internal screw receiving recess 68 of the compression assembly housing 62 such that the threaded external surface 82 of the cylindrical internal screw element 80 threadedly engages the threaded internal surface 70 of the internal screw receiving recess 68. The internal carrier screw 88 is positioned such that the extension portion 92 extends through the screw carrier receiving aperture 84 of the cylindrical internal screw element 80 and slidably engages the extension portion 92 receiving aperture 72 of the compression assembly housing 62, where it is locked in place with a locking nut 78 that is positioned to bear upon the ball bearing assembly 76, thereby allowing the internal carrier screw 88 to rotate freely about an axis. The internally threaded square plug element 90 of the internal carrier screw 88 is engaged with the internal square hole 104 of the hand knob and locked in place with the locking screw 106 positioned through the knob aperture 102 of the hand knob to threadedly engage the internally threaded square plug element 90 such that rotation of the hand knob about the axis causes the internal carrier screw 88 to rotate and move the cylindrical internal screw element 80, under the influence of the threaded external surface 82, between an uncompressed position to a compressed position in which the screw cap bearing surface 86 compresses the spring assembly 110 towards the lower slider member 30. The screw cap bearing surface 86 preferably contacts and presses against a top cap 184 that presses securely against the weaker coil spring 112.

Spring Assembly

Figure 5:
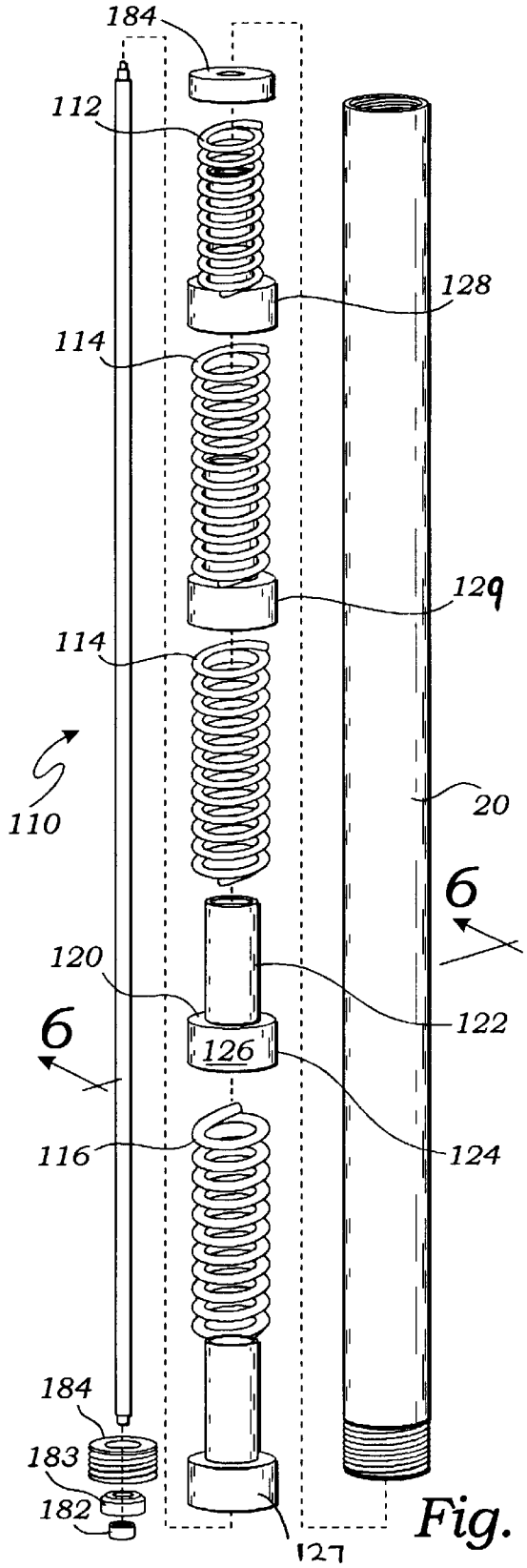
FIG. 5 is an exploded perspective view thereof illustrating a spring assembly positioned within the upper tubular member.
Figure 6:
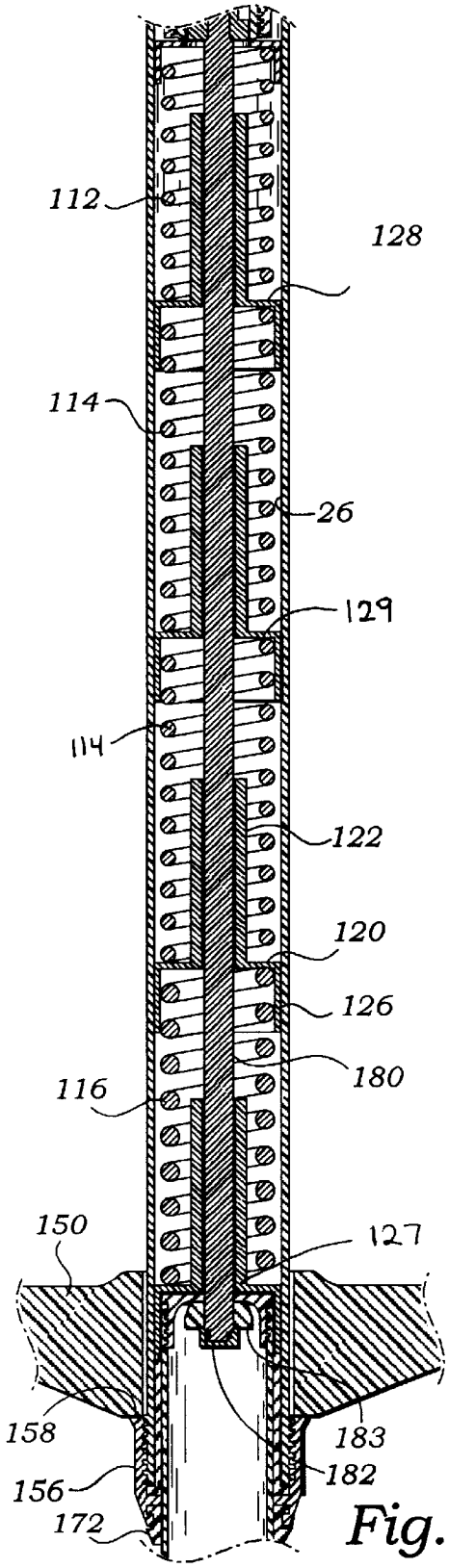
FIG. 6 is a sectional view thereof taken along line 6—6 in FIG. 5.

As shown in FIGS. 5 and 6, the spring assembly 110 preferably includes multiple springs of multiple spring strengths. The use of multiple springs enables the exact performance of the spring assembly 110 to be refined to provide a superior jumping experience. The spring assembly 110 preferably includes a weak coil spring 112, two medium coil springs 114, and a strong coil spring 116. The weak coil spring 112 is designed to function most effectively for lighter users such as smaller children, the medium coil spring 114 is designed to function most effectively with persons of average weight, and the strong coil spring 116 is designed for the heaviest user, or those who jump the most vigorously.

To provide a stable connection between each of the coil springs 112, 114, and 116, the spring assembly 110 further includes a spring carrier 120 positioned between the medium and strong coil springs 114 and 116 and a second spring carrier 128 positioned between the weak and medium coil springs 112 and 114. The spring carrier 120 has an internal cylindrical portion 122 positioned within the medium coil spring 114 and an external cylindrical portion 124 positioned around the strong coil spring 116. The external cylindrical portion 124 provides an external bearing surface 126 for slidably contacting an internal surface 26 of the upper tubular member 20. The spring carrier 120 is preferably constructed of a plastic that is lightweight and that provides a good bearing surface against the aluminum of the internal surface 26 of the upper tubular member 20. A third spring carrier 129 separates the two medium coil springs 114, and a base spring carrier 127 supports the spring assembly 110 from the bottom; the third spring carrier 129 and the base spring carrier 127 are basically structurally the same as the spring carrier 120, and are thus not described in greater detail.

The spring assembly 110 further includes a connecting rod 180 that is positioned down the middle of the upper tubular member 20, through the center of the coil springs 112, 114, and 116, and the spring carriers 120, 128, and 129. The connecting rod 180 is attached at one end to the internal screw carrier 88 through the top cap 184; and the connecting rod 180 is attached at the other end to a bottom cap 186 using a rod locking washer 183 and a rod locking nut 182, although various attachment mechanisms can be devised. The bottom cap 186 is preferably threadedly engaged within the base spring carrier 127.

Bumper

Figure 7:
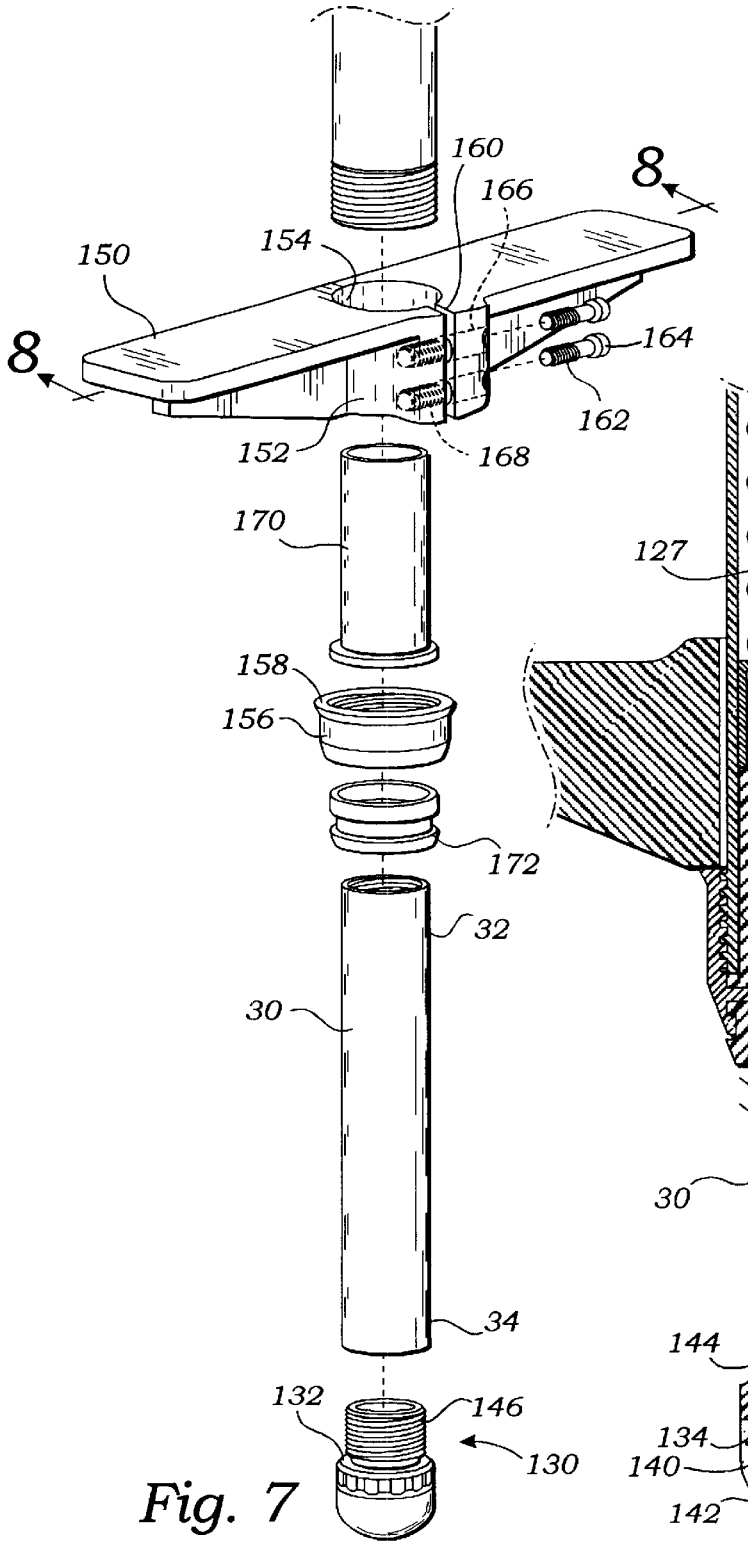
FIG. 7 is an exploded perspective view thereof illustrating a lower end of the upper tubular member, a pair of laterally extending foot pegs, a lower slider member, and a locking collar.
Figure 8:
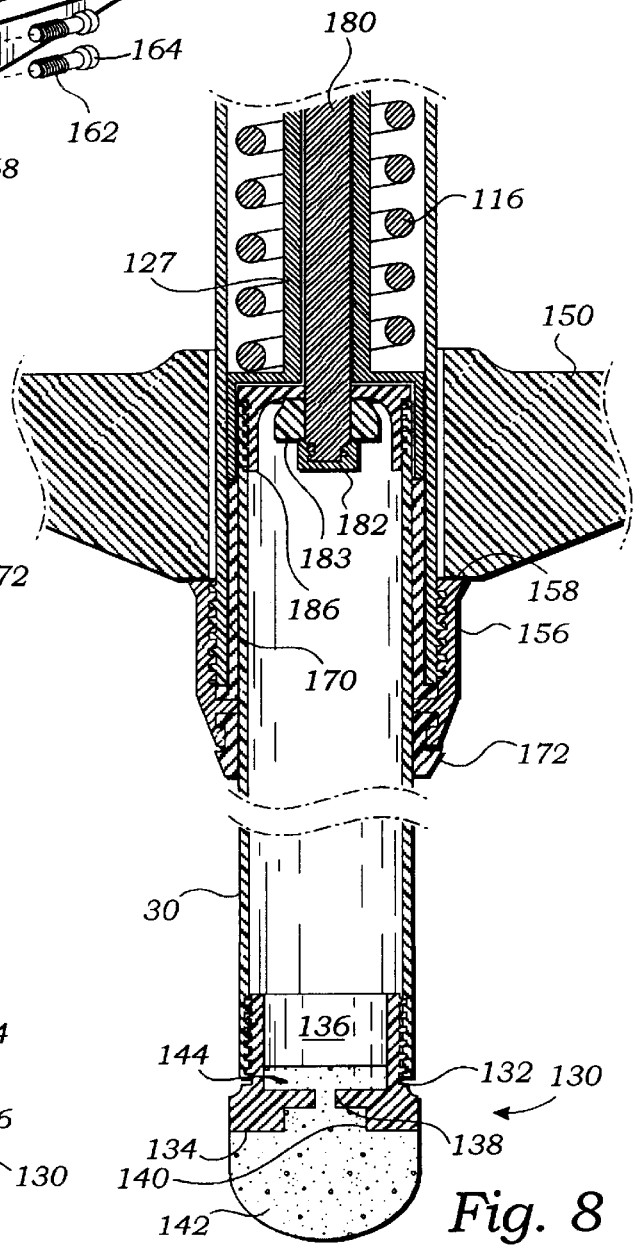
FIG. 8 is a sectional view thereof taken along line 8—8 in FIG. 7.

As shown in FIGS. 7 and 8, the bumper 130 includes a bumper receiver 132 and a rubber element 142 that is co-molded with the bumper receiver 132. The bumper receiver 132 is a molded plastic element that is molded to have a bottom surface 134, a locking compartment 136, and a connecting aperture 138 through the bottom surface 134 to the locking compartment 136. The rubber element 142 is co-molded onto the bottom surface 134 such that a locking portion 144 of the rubber element 142 extends through the connecting aperture 138 and into the locking compartment 136, thereby locking the rubber element 142 onto the bumper receiver 132. The connecting aperture 138 preferably includes a shaped locking portion 140 that is shaped to prevent the rubber element 142 from twisting with respect to the bumper receiver 132. The shaped locking portion 140 preferably has a square cross-section that is coaxially aligned with the connecting aperture 138. By co-molding the rubber element 142 with the bumper receiver 132, the bumper 130 is both inexpensive to manufacture and unusually durable.

The bumper 130 of the present invention contrasts sharply with the prior art bumpers, such as shown in Matsuda, U.S. Pat. No. 3,731,920, hereby incorporated by reference. In Matsuda, the rubber element is positioned around the lower tubular end of the slider of the pogo stick. The prior art has always confronted the problem of the lower tubular end of the pogo stick piercing the rubber element and leaving the pogo stick inoperable. Since there was no way to readily replace the quickly failing rubber elements, prior art pogo sticks have usually enjoyed a short life-span, especially when used by a heavier user whose weight accelerated the destruction of the rubber element.

The bumper 130 further includes a means for attaching the bumper receiver 132 to the bottom end 34 of the lower slider member 30. The means for attaching can include various attachment mechanisms, including fasteners such as screws, pins, or even more permanent attachment mechanisms known in the art, such as adhesives; however, the means for attaching is preferably a mechanism that allows easy replacement of the bumper 130, and preferably includes a bumper threaded portion 146 of the bumper receiver 132 that is adapted to threadedly engage a matching bumper threaded portion 36 of the bottom end 34 of the lower slider member 30. In use, when the rubber element 142 wears out, the user simply unscrews the bumper 130 and replaces it with an inexpensive new part.

Foot Engageable Means

The preferred embodiment of the foot engageable means, which is also shown in FIGS. 7 and 8, preferably includes a pair of laterally extending foot pegs 150 connected to a foot peg base 152 having a foot peg central bore 154, the lower end 24 of the upper tubular member 20 being positioned through the foot peg central bore 154 such that the foot peg base 152 is positioned adjacent to the lower end 24 of the upper tubular member 20.

To lock the foot peg base 152 onto the upper tubular member 20, the foot engageable means further includes a means for preventing lifting of the pair of laterally extending foot pegs 150 with respect to the upper tubular member 20. The means for preventing lifting, very similar to the means for preventing twisting of the pair of laterally extending hand grips 40 described above, preferably includes a foot peg locking slot 160 that exposes the foot peg central bore 154, thereby providing the foot peg base 152 with a generally C-shaped cross-section. The foot peg base 152 further includes a foot peg pinch bolt 162 having a foot peg bolt head 164, a foot peg locking aperture 166 that is large enough to receive the foot peg pinch bolt 162 but not the foot peg bolt head 164, and an internally threaded foot peg locking bore 168 shaped and positioned to receive the foot peg pinch bolt 162 when the foot peg pinch bolt 162 is positioned through the foot peg locking aperture 166 and across the foot peg locking slot 160. The foot peg pinch bolt 162 functions to pinch closed or enable opening of the foot peg locking slot 160 when the foot peg pinch bolt 162 is threadedly rotated into or out of the internally threaded foot peg locking bore 168. By tightening the foot peg pinch bolt 162, or preferably the pair of foot peg pinch bolts 162, the foot peg locking slot 160 is closed so that the foot peg base 152 tightly clamps the upper tubular member 20 and friction prevents movement of the foot peg base 152 with respect to the upper tubular member 20. This design is an important improvement over the prior art, as described above, because there is no welding required and the integrity of the upper tubular member 20 is not broken.

While the above-described structure provides a reasonably strong connection, it is often not strong enough to support the full weight of the user while bouncing on the pogo stick 10. To provide the foot peg base 152 with the necessary additional support, the foot engageable means further includes a locking collar 156 threadedly engaged to the lower end 24 beneath the foot peg base 152 such that an upper rim 158 of the locking collar 156 supports the foot peg base 152. A seal 172 is positioned beneath the locking collar 156 to exclude dirt and debris. Additional improvements made to the pogo stick 10 include the addition of a plastic bearing sleeve 170 covering the internal surface 26 of the upper tubular member 20. The plastic bearing sleeve 170 protects the lower slider member 30 while it slides into and out of the upper tubular member 20.

The structural components of the pogo stick 10, particularly including the upper tubular member 20 and the lower slider member 30, are constructed of a lightweight, rigid, durable, and strong material, preferably aluminum. The components of the spring assembly 110 that contact the internal surface 26 of the upper tubular member 20, within the pogo stick 10, especially the plastic bearing sleeve 170, the spring carrier 120, the base spring carrier 127, and the second and third spring carriers 128 and 129, are preferably constructed of durable plastic that can provide a good bearing surface against the aluminum of the internal surface 26 to minimize the wear on the internal surface 26. The internal surface 26 is preferably hard anodized to further reduce wear from the friction of use.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A pogo stick comprising:

an upper tubular member having a hand graspable means on an upper end and a foot engageable means on a lower end;

a lower slider member having a top end and a bottom end, the top end being shaped to telescopically engage the lower end of the upper tubular member, the lower slider member sliding between a retracted position and an extended position;

a bumper positioned on the bottom end of the lower slider member;

a spring assembly in the upper tubular member for biasing the lower slider member towards the extended position, the spring assembly including a medium coil spring and a strong coil spring; and a spring carrier positioned between the medium and strong coil springs, the spring carrier having an internal cylindrical portion positioned within the medium coil spring and an external cylindrical portion positioned around the strong coil spring, the external cylindrical portion providing an external bearing surface for slidably contacting an internal surface of the upper tubular member.

2. The pogo stick of claim 1 wherein the spring assembly further includes a weak coil spring and a second spring carrier, the weak coil spring and the medium coil spring being separated by the second spring carrier.

3. The pogo stick of claim 1 further comprising a means for compressing the spring assembly, the means for compressing being positioned at the upper end of the upper tubular member to compress the spring assembly towards the lower slider member.

4. The pogo stick of claim 3 wherein the means for compressing is a compression assembly comprising:

a compression assembly housing attached to the upper end of the upper tubular member, the compression assembly housing having an internal screw receiving recess with a threaded internal surface;

a cylindrical internal screw element having a threaded external surface, the threaded external surface threadedly engaging the threaded internal surface when the cylindrical internal screw element is inserted into the internal screw receiving recess; and a means for rotating the cylindrical internal screw element, thereby moving the cylindrical internal screw element between an uncompressed position and a compressed position in which the cylindrical internal screw element compresses the spring element towards the lower slider member.

5. The pogo stick of claim 1 further comprising a compression assembly attached to the upper end of the upper tubular member and positioned for adjustably compressing the spring assembly, the compression assembly including an internal carrier screw having an internally threaded square plug element, an extension portion having a circular cross section, a square rod section, and a screw stop;

a cylindrical internal screw element having a screw carrier receiving aperture at one end and a screw cap bearing surface at the other end, the screw carrier receiving aperture being shaped to slidably engage the square rod section when the internal carrier screw is inserted through the screw carrier receiving aperture, but not allow the screw stop to pass therethrough;

a compression assembly housing having an internal screw receiving recess, an extension portion receiving aperture surrounded by a ball bearing receiving recess, and a threaded housing surface, the internal screw receiving recess having a threaded internal surface;

a ball bearing assembly positioned within the ball bearing receiving recess;

a hand knob having a knob aperture and an internal square hole; and a locking screw, the compression assembly housing threadedly engaging the upper end of the upper tubular member with a threaded housing surface, the cylindrical internal screw element being positioned within the internal screw receiving recess of the compression assembly housing such that the threaded external surface of the cylindrical internal screw element threadedly engages the threaded internal surface of the internal screw receiving recess, the internal carrier screw being positioned such that the extension portion extends through the screw carrier receiving aperture of the cylindrical internal screw element and slidably engages the extension portion receiving aperture of the compression assembly housing, where it is locked in place with a locking nut that is positioned to bear upon the ball bearing assembly, thereby allowing the internal carrier screw to rotate freely about an axis, the internally threaded square plug element of the internal carrier screw engaging the internal square hole of the hand knob and being locked in place with the locking screw positioned through the knob aperture of the hand knob to threadedly engage the internally threaded square plug element such that rotation of the hand knob about the axis causes the internal carrier screw to rotate and move the cylindrical internal screw element, under the influence of the threaded external surface, between an uncompressed position to a compressed position in which the screw cap bearing surface compresses the spring assembly towards the lower slider member.

6. The pogo stick of claim 1 wherein the bumper includes:

a bumper receiver including a bottom surface, a locking compartment, and a connecting aperture through the bottom surface to the locking compartment;

a rubber element co-molded onto the bottom surface such that a locking portion of the rubber element extends through the connecting aperture and into the locking compartment, thereby locking the rubber element onto the bumper receiver; and a means for attaching the bumper receiver to the bottom end of the lower slider member.

7. The pogo stick of claim 6 wherein the connecting aperture includes a shaped locking portion that is shaped to prevent the rubber element from twisting with respect to the bumper receiver.

8. The pogo stick of claim 7 wherein the shaped locking portion has a square cross-section that is coaxially aligned with the connecting aperture.

9. The pogo stick of claim 6 wherein the means for attaching the bumper receiver to the bottom end of the lower slider member includes a bumper threaded portion of the bumper receiver that is adapted to threadedly engage a matching bumper threaded portion of the bottom end of the lower slider member.

10. The pogo stick of claim 1 wherein the hand graspable means includes:

a pair of laterally extending hand grips connected to a hand grip base having a hand grip central bore, the hand grip central bore having an internal lip shaped to block passage of the upper end of the upper tubular member when the upper tubular member is inserted into the hand grip central bore; and a means for preventing twisting of the pair of laterally extending hand grips with respect to the upper tubular member.

11. The pogo stick of claim 10 wherein the means for preventing twisting includes:

a hand grip locking slot that exposes the hand grip central bore, thereby providing the hand grip base with a generally C-shaped cross-section;

a hand grip pinch bolt having a hand grip bolt head;

a hand grip locking aperture that is large enough to receive the hand grip pinch bolt but not the hand grip bolt head; and an internally threaded hand grip locking bore shaped and positioned to receive the hand grip pinch bolt when the hand grip pinch bolt is positioned through the hand grip locking aperture and across the hand grip locking slot, the hand grip pinch bolt functioning to pinch closed or enable opening of the hand grip locking slot when the hand grip pinch bolt is threadedly rotated into or out of the internally threaded hand grip locking bore.

12. The pogo stick of claim 10 wherein the hand graspable means further includes a cap attachable to the upper end of the upper tubular member over the hand grip base, the cap having a locking flange that locks the internal lip against the upper end.

13. The pogo stick of claim 1 wherein the foot engageable means includes:

a pair of laterally extending foot pegs connected to a foot peg base having a foot peg central bore, the lower end of the upper tubular member being positioned through the foot peg central bore such that the foot peg base is positioned adjacent the lower end of the upper tubular member;

a locking collar threadedly engaged to the lower end beneath the foot peg base such that an upper rim of the locking collar supports the foot peg base; and a means for preventing lifting of the pair of laterally extending foot pegs with respect to the upper tubular member.

14. The pogo stick of claim 13 wherein the means for preventing lifting includes:

a foot peg locking slot that exposes the foot peg central bore, thereby providing the foot peg base with a generally C-shaped cross-section;

a foot peg pinch bolt having a foot peg bolt head;

a foot peg locking aperture that is large enough to receive the foot peg pinch bolt but not the foot peg bolt head; and an internally threaded foot peg locking bore shaped and positioned to receive the foot peg pinch bolt when the foot peg pinch bolt is positioned through the foot peg locking aperture and across the foot peg locking slot, the foot peg pinch bolt functioning to pinch closed or enable opening of the foot peg locking slot when the foot peg pinch bolt is threadedly rotated into or out of the internally threaded foot peg locking bore.

15. A pogo stick comprising:

an upper tubular member having a hand graspable means on an upper end and a foot engageable means on a lower end;

a lower slider member having a top end and a bottom end, the top end being shaped to telescopically engage the lower end of the upper tubular member, the lower slider member sliding between a retracted position and an extended position;

a bumper positioned on the bottom end of the lower slider member;

a spring assembly in the upper tubular member for biasing the lower slider member towards the, extended position, the spring assembly including a medium coil spring and a strong coil spring:

the hand graspable means including a pair of laterally extending hand grips connected to a hand grip base having a hand grip central bore, the hand grip central bore having an internal lip shaped to block passage of the upper end of the upper tubular member when the upper tubular member is inserted into the hand grip central bore; and a means for preventing twisting of the pair of laterally extending hand grips with respect to the upper tubular member.

16. The pogo stick of claim 15 wherein the means for preventing twisting includes:

a hand grip locking slot that exposes the hand grip central bore, thereby providing the hand grip base with a generally C-shaped cross-section;

a hand grip pinch bolt having a hand grip bolt head;

a hand grip locking aperture that is large enough to receive the hand grip pinch bolt but not the hand grip bolt head; and an internally threaded hand grip locking bore shaped and positioned to receive the hand grip pinch bolt when the hand grip pinch bolt is positioned through the hand grip locking aperture and across the hand grip locking slot, the hand grip pinch bolt functioning to pinch closed or enable opening of the hand grip locking slot when the hand grip pinch bolt is threadedly rotated into or out of the internally threaded hand grip locking bore.

17. The pogo stick of claim 15 wherein the hand graspable means further includes a cap attachable to the upper end of the upper tubular member over the hand grip base, the cap having a locking flange that locks the internal lip against the upper end.

18. The pogo stick of claim 15 further comprising a means for compressing the spring assembly, the means for compressing being positioned at the upper end of the upper tubular member to compress the spring assembly towards the lower slider member.

19. The pogo stick of claim 18 wherein the means for compressing is a compression assembly comprising:

a compression assembly housing attached to the upper end of the upper tubular member, the compression assembly housing having an internal screw receiving recess with a threaded internal surface;

a cylindrical internal screw element having a threaded external surface, the threaded external surface threadedly engaging the threaded internal surface when the cylindrical internal screw element is inserted into the internal screw receiving recess; and a means for rotating the cylindrical internal screw element, thereby moving the cylindrical internal screw element between an uncompressed position and a compressed position in which the cylindrical internal screw element compresses the spring element towards the lower slider member.

20. The pogo stick of claim 15 further comprising a compression assembly attached to the upper end of the upper tubular member and positioned for adjustably compressing the spring assembly, the compression assembly including an internal carrier screw having an internally threaded square plug element, an extension portion having a circular cross section, a square rod section, and a screw stop;

a cylindrical internal screw element having a screw carrier receiving aperture at one end and a screw cap bearing surface at the other end, the screw carrier receiving aperture being shaped to slidably engage the square rod section when the internal carrier screw is inserted through the screw carrier receiving aperture, but not allow the screw stop to pass therethrough;

a compression assembly housing having an internal screw receiving recess, an extension portion receiving aperture surrounded by a ball bearing receiving recess, and a threaded housing surface, the internal screw receiving recess having a threaded internal surface;

a ball bearing assembly positioned within the ball bearing receiving recess;

a hand knob having a knob aperture and an internal square hole; and a locking screw, the compression assembly housing threadedly engaging the upper end of the upper tubular member with a threaded housing surface, the cylindrical internal screw element being positioned within the internal screw receiving recess of the compression assembly housing such that the threaded external surface of the cylindrical internal screw element threadedly engages the threaded internal surface of the internal screw receiving recess, the internal carrier screw being positioned such that the extension portion extends through the screw carrier receiving aperture of the cylindrical internal screw element and slidably engages the extension portion receiving aperture of the compression assembly housing, where it is locked in place with a locking nut that is positioned to bear upon the ball bearing assembly, thereby allowing the internal carrier screw to rotate freely about an axis, the internally threaded square plug element of the internal carrier screw engaging the internal square hole of the hand knob and being locked in place with the locking screw positioned through the knob aperture of the hand knob to threadedly engage the internally threaded square plug element such that rotation of the hand knob about the axis causes the internal carrier screw to rotate and move the cylindrical internal screw element, under the influence of the threaded external surface, between an uncompressed position to a compressed position in which the screw cap bearing surface compresses the spring assembly towards the lower slider member.

21. The pogo stick of claim 15 wherein the bumper includes:

a bumper receiver including a bottom surface, a locking compartment, and a connecting aperture through the bottom surface to the locking compartment;

a rubber element co-molded onto the bottom surface such that a locking portion of the rubber element extends through the connecting aperture and into the locking compartment, thereby locking the rubber element onto the bumper receiver; and a means for attaching the bumper receiver to the bottom end of the lower slider member.

22. The pogo stick of claim 21 wherein the connecting aperture includes a shaped locking portion that is shaped to prevent the rubber element from twisting with respect to the bumper receiver.

23. The pogo stick of claim 22 wherein the shaped locking portion has a square cross-section that is coaxially aligned with the connecting aperture.

24. The pogo stick of claim 21 wherein the means for attaching the bumper receiver to the bottom end of the lower slider member includes a bumper threaded portion of the bumper receiver that is adapted to threadedly engage a matching bumper threaded portion of the bottom end of the lower slider member.

25. The pogo stick of claim 15 wherein the foot engageable means includes:

a pair of laterally extending foot pegs connected to a foot peg base having a foot peg central bore, the lower end of the upper tubular member being positioned through the foot peg central bore such that the foot peg base is positioned adjacent the lower end of the upper tubular member;

a locking collar threadedly engaged to the lower end beneath the foot peg base such that an upper rim of the locking collar supports the foot peg base; and a means for preventing lifting of the pair of laterally extending foot pegs with respect to the upper tubular member.

26. The pogo stick of claim 25 wherein the means for preventing lifting includes:

a foot peg locking slot that exposes the foot peg central bore, thereby providing the foot peg base with a generally C-shaped cross-section;

a foot peg pinch bolt having a foot peg bolt head;

a foot peg locking aperture that is large enough to receive the foot peg pinch bolt but not the foot peg bolt head; and an internally threaded foot peg locking bore shaped and positioned to receive the foot peg pinch bolt when the foot peg pinch bolt is positioned through the foot peg locking aperture and across the foot peg locking slot, the foot peg pinch bolt functioning to pinch closed or enable opening of the foot peg locking slot when the foot peg pinch bolt is threadedly rotated into or out of the internally threaded foot peg locking bore.

27. A pogo stick comprising:

an upper tubular member having a hand graspable means on an upper end and a foot engageable means on a lower end;

a lower slider member having a top end and a bottom end, the top end being shaped to telescopically engage the lower end of the upper tubular member, the lower slider member sliding between a retracted position and an extended position;

a bumper positioned on the bottom end of the lower slider member;

a spring assembly in the upper tubular member for biasing the lower slider member towards the extended position A spring carrier positioned between the medium and strong coil springs;

the foot engageable means including a pair of laterally extending foot pegs connected to a foot peg base having a foot peg central bore, the lower end of the upper tubular member being positioned through the foot peg central bore such that the foot peg base is positioned adjacent the lower end of the upper tubular member;

a locking collar threadedly engaged to the lower end beneath the foot peg base such that an upper rim of the locking collar supports the foot peg base; and a means for preventing lifting of the pair of laterally extending foot pegs with respect to the upper tubular member.

28. The pogo stick of claim 27 wherein the means for preventing lifting includes:

a foot peg locking slot that exposes the foot peg central bore, thereby providing the foot peg base with a generally C-shaped cross-section;

a foot peg pinch bolt having a foot peg bolt head;

a foot peg locking aperture that is large enough to receive the foot peg pinch bolt but not the foot peg bolt head; and an internally threaded foot peg locking bore shaped and positioned to receive the foot peg pinch bolt when the foot peg pinch bolt is positioned through the foot peg locking aperture and across the foot peg locking slot, the foot peg pinch bolt functioning to pinch closed or enable opening of the foot peg locking slot when the foot peg pinch bolt is threadedly rotated into or out of the internally threaded foot peg locking bore.

29. The pogo stick of claim 27 further comprising a means for compressing the spring assembly, the means for compressing being positioned at the upper end of the upper tubular member to compress the spring assembly towards the lower slider member.

30. The pogo stick of claim 29 wherein the means for compressing is a compression assembly comprising:

a compression assembly housing attached to the upper end of the upper tubular member, the compression assembly housing having an internal screw receiving recess with a threaded internal surface;

a cylindrical internal screw element having a threaded external surface, the threaded external surface threadedly engaging the threaded internal surface when the cylindrical internal screw element is inserted into the internal screw receiving recess; and a means for rotating the cylindrical internal screw element, thereby moving the cylindrical internal screw element between an uncompressed position and a compressed position in which the cylindrical internal screw element compresses the spring element towards the lower slider member.

31. The pogo stick of claim 27 wherein the bumper includes:

a bumper receiver including a bottom surface, a locking compartment, and a connecting aperture through the bottom surface to the locking compartment;

a rubber element co-molded onto the bottom surface such that a locking portion of the rubber element extends through the connecting aperture and into the locking compartment, thereby locking the rubber element onto the bumper receiver; and a means for attaching the bumper receiver to the bottom end of the lower slider member.

32. The pogo stick of claim 27 wherein the hand graspable means includes:

a pair of laterally extending hand grips connected to a hand grip base having a hand grip central bore, the hand grip central bore having an internal lip shaped to block passage of the upper end of the upper tubular member when the upper tubular member is inserted into the hand grip central bore; and a means for preventing twisting of the pair of laterally extending hand grips with respect to the upper tubular member.

33. The pogo stick of claim 32 wherein the means for preventing twisting includes:

a hand grip locking slot that exposes the hand grip central bore, thereby providing the hand grip base with a generally C-shaped cross-section;

a hand grip pinch bolt having a hand grip bolt head;

a hand grip locking aperture that is large enough to receive the hand grip pinch bolt but not the hand grip bolt head; and an internally threaded hand grip locking bore shaped and positioned to receive the hand grip pinch bolt when the hand grip pinch bolt is positioned through the hand grip locking aperture and across the hand grip locking slot, the hand grip pinch bolt functioning to pinch closed or enable opening of the hand grip locking slot when the hand grip pinch bolt is threadedly rotated into or out of the internally threaded hand grip locking bore.

34. The pogo stick of claim 33 wherein the hand graspable means further includes a cap attachable to the upper end of the upper tubular member over the hand grip base, the cap having a locking flange that locks the internal lip against the upper end.

35. A pogo stick comprising:

an upper tubular member having a hand graspable means on an upper end and a foot engageable means on a lower end;

a lower slider member having a top end and a bottom end, the top end being shaped to telescopically engage the lower end of the upper tubular member, the lower slider member sliding between a retracted position and an extended position;

a spring assembly in the upper tubular member for biasing the lower slider member towards the extended position, the spring including a medium coil spring and a strong coil spring; a spring carrier positioned between the medium and strong coil springs; and a bumper having a bumper receiver and a rubber element, the bumper receiver including a bottom surface, a locking compartment, and a connecting aperture through the bottom surface to the locking compartment, the rubber element co-molded onto the bottom surface such that a locking portion of the rubber element extends through the connecting aperture and into the locking compartment, thereby locking the rubber element onto the bumper receiver, and a means for removably attaching the bumper receiver to the bottom end of the lower slider member.

36. The pogo stick of claim 35 wherein the connecting aperture includes a shaped locking portion that is shaped to prevent the rubber element from twisting with respect to the bumper receiver.

37. The pogo stick of claim 36 wherein the shaped locking portion has a square cross-section that is coaxially aligned with the connecting aperture.

38. The pogo stick of claim 35 wherein the means for removably attaching the bumper receiver to the bottom end of the lower slider member includes a bumper threaded portion of the bumper receiver that is adapted to threadedly engage a matching bumper threaded portion of the bottom end of the lower slider member.

* * * * *